US010406587B2

(12) United States Patent
Beauchamp et al.

(10) Patent No.: US 10,406,587 B2
(45) Date of Patent: Sep. 10, 2019

(54) METHOD AND DIE SET FOR FORMING A SURFACE IN A METAL PANEL

(71) Applicant: GM GLOBAL TECHNOLOGY OPERATIONS LLC, Detroit, MI (US)

(72) Inventors: Brian J. Beauchamp, Clio, MI (US); Benjamin P. Hunault, Grand Blanc, MI (US); John G. Peck, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 580 days.

(21) Appl. No.: 15/087,380

(22) Filed: Mar. 31, 2016

(65) Prior Publication Data

US 2017/0282235 A1 Oct. 5, 2017

(51) Int. Cl.

| | |
|---|---|
| ***B21D 19/08*** | (2006.01) |
| ***B21D 22/22*** | (2006.01) |
| ***B21D 22/26*** | (2006.01) |
| ***B21D 47/00*** | (2006.01) |
| ***B21D 24/04*** | (2006.01) |
| *B21D 53/88* | (2006.01) |

(52) U.S. Cl.

CPC ..... *B21D 47/00* (2013.01); *B21D 19/08* (2013.01); *B21D 22/22* (2013.01); *B21D 22/26* (2013.01); *B21D 24/04* (2013.01); *B21D 53/88* (2013.01)

(58) Field of Classification Search

CPC ..... B21D 47/00; B21D 24/04; B21D 22/22; B21D 19/08; B21D 22/26; B21D 53/88

See application file for complete search history.

(56) References Cited

U.S. PATENT DOCUMENTS

2010/0186475 A1* 7/2010 Hirotani ..... B21D 22/22 72/349
2017/0232492 A1* 8/2017 Isogai ..... B21C 37/08 138/171

FOREIGN PATENT DOCUMENTS

| | | | |
|---|---|---|---|
| CN | 101054003 | A | 10/2007 |
| CN | 101612637 | A | 12/2009 |
| CN | 101786122 | A | 7/2010 |
| CN | 101873901 | A | 10/2010 |
| DE | 3623188 | C1 | 9/1987 |
| JP | 2005021945 | A | 1/2005 |

* cited by examiner

*Primary Examiner* — Jacob J Cigna
*Assistant Examiner* — Lee A Holly
(74) *Attorney, Agent, or Firm* — Quinn IP Law

(57) ABSTRACT

A method of forming a surface in a panel includes positioning a panel blank between a stationary die and a moveable die of a die set, and moving the moveable die toward the stationary die to deform the panel blank therebetween. Positive stresses in the panel blank are maintained in the region of the panel blank that will form the surface by forming a bead along a length of the surface to be formed in the panel blank, as the moveable die moves toward the stationary die. The moveable die continues to move toward the stationary die, while maintaining positive stresses in the panel blank in the region of the panel blank that will form the surface, to further deform the panel blank into a formed shape that includes the surface.

12 Claims, 6 Drawing Sheets

METHOD AND DIE SET FOR FORMING A SURFACE IN A METAL PANEL

TECHNICAL FIELD

The disclosure generally relates to a method of forming a surface in a metal panel, and a die set for forming the surface.

BACKGROUND

Press forming metal panels into complex shapes often causes waviness or deviations in the formed surfaces of the panel. Such deviations are undesirable, and must be smoothed before other operations may be performed on the panel, such as painting or laser brazing, or in order to provide a quality, finished appearance.

Laser brazing is a process that may be used to attach two metal panels together. The two panels are mated together along a seam, and the laser brazing process attaches the panels along a length of the seam. Typically, each of the panels will be formed to include a brazing surface, which are mated together and define the seam therebetween. In order to achieve a high quality finish, the laser brazing process requires that the seam between the two panels is very tight, with very little deviation or variance between the panels. This requires that the brazing surface of each of the panels does not include any waviness, deformations, or deviation from an ideal surface shape. Waviness or deviations from the ideal surface shape in the brazing surfaces greater than an allowable tolerance will cause the seam to be too wide, and prevent a quality joining of the two panels.

In the context of a vehicle, the laser brazing process may be used, for example, to join a body side panel to a roof panel. However, due to the three dimensional shapes in the exterior surface of vehicular bodies, the brazing surface on the body side panel often follows a very complex three dimensional path, and often must be formed in a "Z" bend portion of the panel, which makes it very difficult to press form a satisfactory brazing surface into the panels, and often introduces undesirable or unacceptable waviness into the brazing surface.

SUMMARY

A method of forming a surface in a metal panel is provided. The method includes providing a die set having a stationary die and a moveable die. The stationary die and the moveable die cooperate to define a formed shape therebetween. One of the stationary die and the moveable die includes a male bead forming portion, and the other of the stationary die and the moveable die includes a female bead forming portion. The formed shape includes the surface that extends along a path, and a bead formed between the male bead forming portion and the female bead forming portion, which extends generally parallel with the path of the surface. A panel blank is positioned between the stationary die and the moveable die. The moveable die is moved toward the stationary die to deform the panel blank therebetween. The male bead forming portion and the female bead forming portion engage and deform the panel blank therebetween to form the bead during initial movement of the moveable die toward the stationary die. Formation of the bead induces tensile forces in both a first direction parallel to the path of the surface, and a second direction transverse to the path of the surface. The moveable die continues to move toward the stationary die to further deform the panel blank therebetween, while the bead is being formed between the male bead forming portion and the female bead forming portion, and while the panel blank includes tensile forces in both the first direction and the second direction relative to the path of the surface. The moveable die continues to move toward the stationary die to define the formed shape of the panel blank having the surface.

A method of forming a surface in a panel is also provided. The method includes positioning a panel blank between a stationary die and a moveable die of a die set. The moveable die is then moved toward the stationary die to deform the panel blank therebetween. Positive stresses in the panel blank are maintained in the region of the panel blank that will form the surface, as the moveable die moves toward the stationary die. The moveable die continues to move toward the stationary die, while maintaining positive stresses in the panel blank in the region of the panel blank that will form the surface, to further deform the panel blank into a formed shape that includes the surface.

A die set for forming a panel having a surface is also provided. The die set includes a stationary die and an opposing moveable die. The moveable die is disposed opposite the stationary die. The moveable die is operable to move toward and away from the stationary die. A clamp is attached to the stationary die. The clamp is operable to secure a panel blank to the stationary die. The moveable die includes a moveable brazing formation surface, and the stationary die includes a stationary brazing formation surface. The stationary brazing formation surface opposes the moveable brazing formation surface for forming a surface in the panel blank therebetween. One of the moveable die and the stationary die includes a male bead forming portion, and the other of the moveable die and the stationary die includes a female bead forming portion. The female bead forming portion is disposed opposite the male bead forming portion for forming a bead in the panel blank therebetween. The male bead forming portion and the female bead forming portion extend in a continuous and uninterrupted, generally parallel relationship with the moveable brazing formation surface and the stationary brazing formation surface. The male bead forming portion and the female bead forming portion are disposed opposite the clamp and across the moveable brazing formation surface and the stationary brazing formation surface from the clamp. The male bead forming portion and the female bead forming portion are operable to engage the panel blank during initial movement of the moveable die toward the stationary die, for inducing tensile forces in both a first direction parallel to a path of the surface and a second direction transverse to the path of the surface.

Accordingly, formation of the bead in the panel blank maintains or induces tensile stresses in the panel blank in the region of the panel blank that forms the surface, in all directions, i.e., in both the first direction (along a major axis of the surface) and the second direction (along a minor axis of the surface). The tensile stresses may be defined as stresses having a positive value, and prevent waviness or crumpling of the panel blank in the region of the panel blank that forms the surface, while the surface is being formed between the moveable die and the stationary die. Because the region of the panel blank that forms the surface is in tension in all directions, no material flows into this region during the pressing process, which prevents waviness in the surface. A surface formed with the above described process is suitable for laser brazing operations and/or other finish operations, without any additional metal working required.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, a method of forming a surface 20 in a panel blank 22 is described. The surface 20 may include any formed surface in the press formed panel blank 22. The exemplary embodiment of the process described herein teaches the formation of a brazing surface in the panel blank, and therefore refers to the surface 20 as the brazing surface 20. However, it should be appreciated that the surface 20 is not limited to only the exemplary embodiment of the brazing surface 20 described herein, and that the teachings of the disclosure may be applied to other formed surfaces in the panel blank 22.

Figure 1:
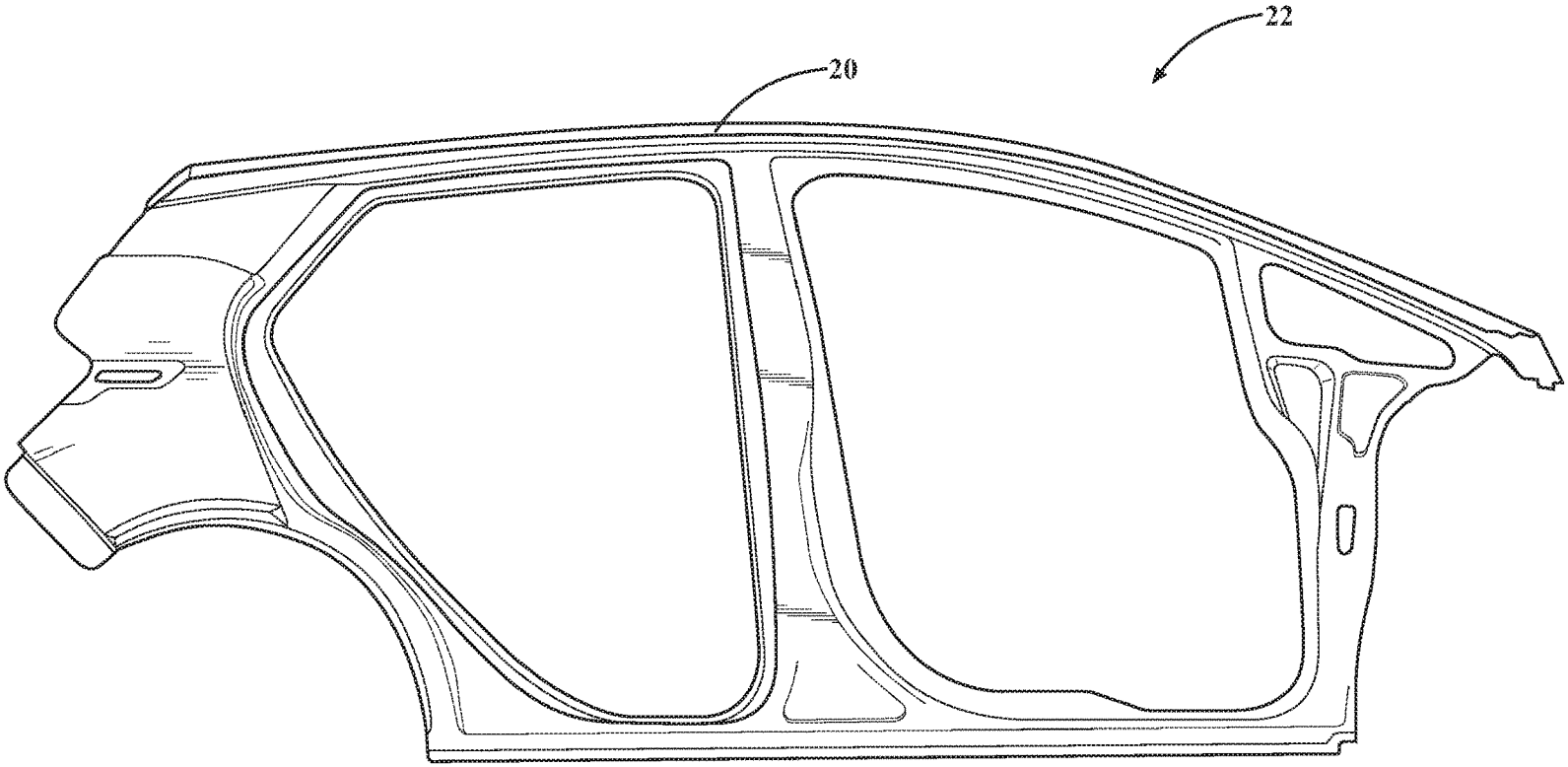
FIG. 1 is a plan view of a panel blank having a final formed shape.
Figure 2:
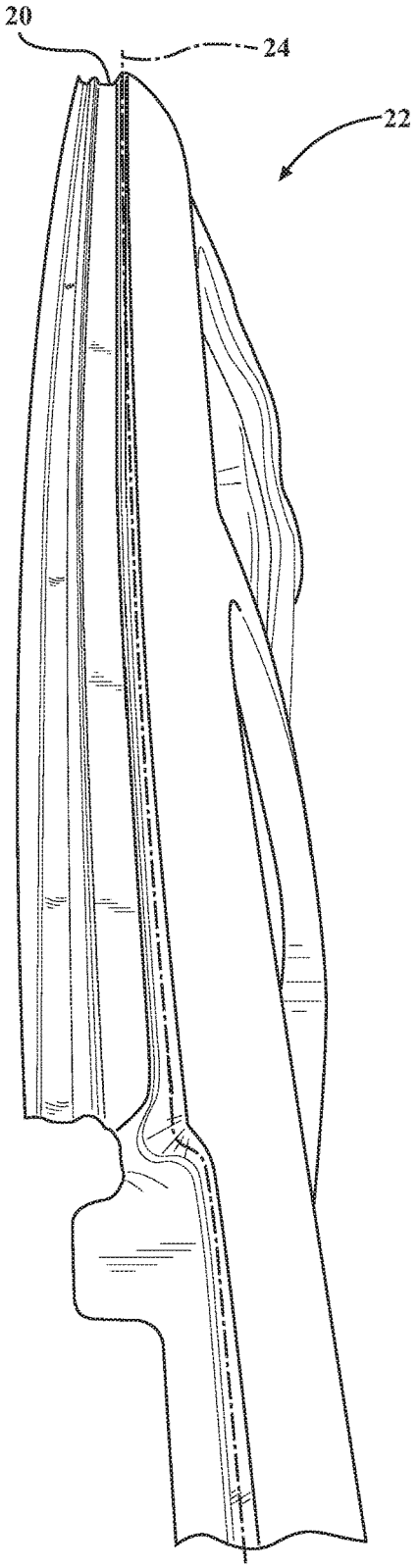
FIG. 2 is a perspective view of the panel blank having the final formed shape.

Referring to FIG. 1, the panel blank 22 may be formed to define any desirable shape, including but not limited to a body side panel of a vehicle, such as a car, truck, SUV, tractor, plane, boat, etc.; a roof panel of a vehicle, such as a car, truck, SUV, tractor, plane, boat, etc.; an exterior panel of an appliance, such as a refrigerator, stove, etc.; or some other form of panel not specifically noted herein. Referring to FIG. 2, the brazing surface 20 may include any surface on the panel blank 22 that is configured to be abutted against another panel to provide a suitable seam for a brazing process, such as but is not limited to, a roof brazing surface 20 on a body side panel of a vehicle for brazing attachment to a roof panel of the vehicle. The brazing surface 20 extends along a path 24, best shown in FIG. 2. The path 24 is generally defined as a centerline of the brazing surface 20, and may define a straight linear path 24, a non-linear path 24 that simultaneously changes directions in only two dimensions, or a non-linear path 24 that simultaneously changes directions in three dimensions.

Figure 3:
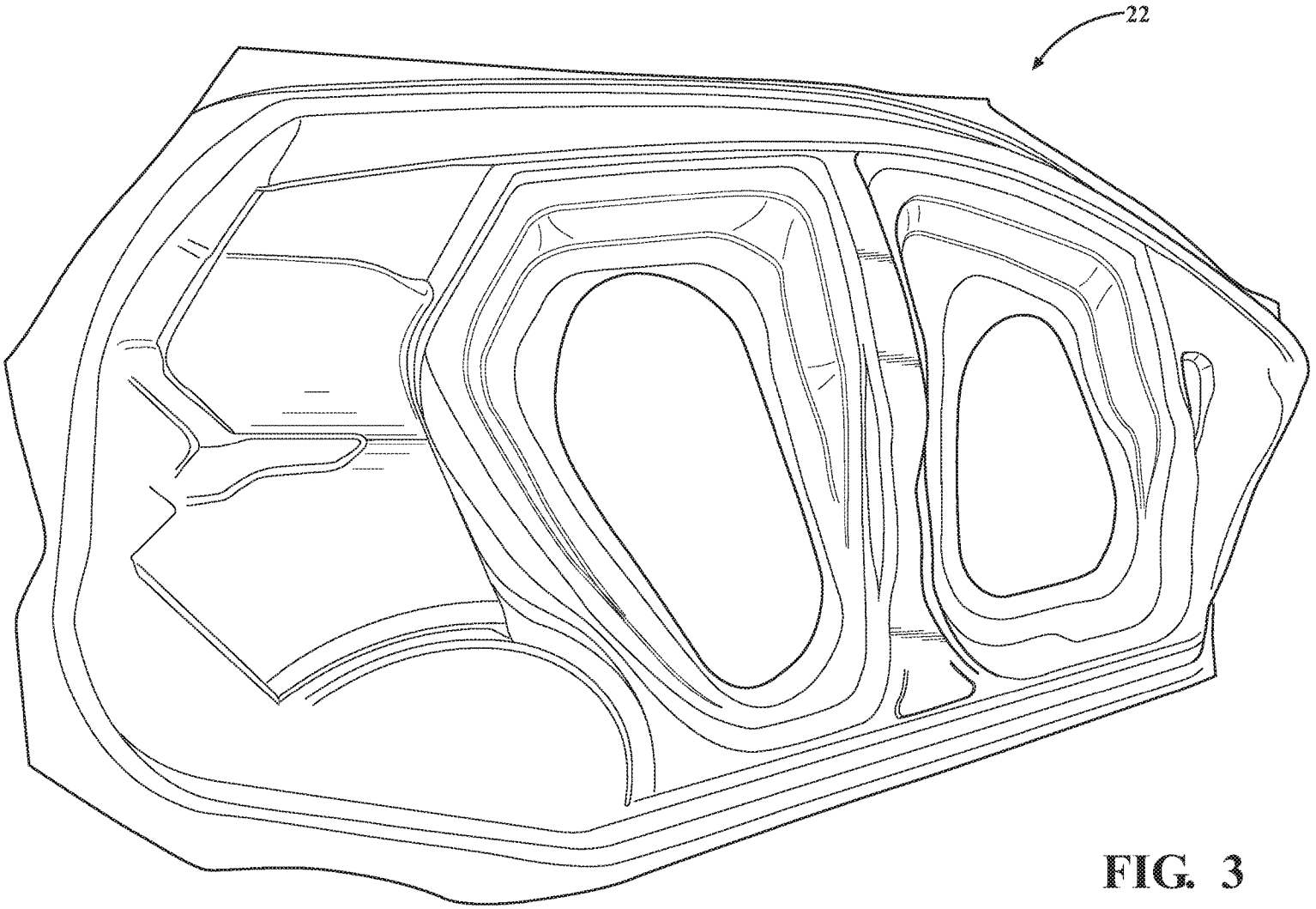
FIG. 3 is a perspective view of the panel blank having an intermediate shape.

The method may include pre-forming a metal panel to define the panel blank 22. The metal panel typically includes a planar sheet of metal, such as steel, aluminum, titanium, etc., and is deformed using known metal forming technologies to define an intermediate shape, shown in FIG. 3, forming the panel blank 22. The metal forming technologies used to form the metal panel into the panel blank 22 may include, but are not limited to, metal pressing, punching, shaping, grinding, or other similar known processes used to shape planar panels into three dimension shapes. The metal panel may be pre-formed to define the panel blank 22 prior to positioning the panel blank 22 within a die set 26, described in greater detail below. The step of pre-forming the metal panel to define the metal blank may be considered a first forming process, such that the intermediate shape of the panel blank 22 shown in FIG. 3 generally, but not completely, defines a final formed shape of the panel blank 22. Accordingly, the intermediate shape of the panel blank 22 may be considered only partially formed. The forming process described below, used to form the brazing surface 20, may be considered a secondary forming process the completely defines the final formed shape of the panel blank 22 that is shown in FIG. 1. It should be appreciated that the teachings of this disclosure on how to form the finished surface 20 may be applied in either the first forming process, the secondary forming process, or any other subsequent forming processes for the panel blank 22.

The method includes providing the die set 26 necessary to deform the intermediate shape of the panel blank 22 into the final formed shape of the panel blank 22. The die set 26 may be manufactured in any suitable manner known to those skilled in the art. Although the specific shape of the die set 26 described herein is unique to the process described herein, the methods of manufacturing the die set 26 are known to those skilled in the art, and are therefore not described in detail herein.

Referring to FIGS. 4 through 9, the exemplary embodiment of the die set 26 includes a stationary die 28 and an opposing moveable die 30. The die set 26 is used to perform a pressing process to deform the panel blank 22 as described herein. The pressing process may include any suitable process that deforms a panel between two or more die halves. Suitable pressing processes are known to those skilled in the art, and are not described in detail herein. However, in generic terms, the moveable die 30 is generally disposed opposite the stationary die 28, and is operable to move toward and away from the stationary die 28. The moveable die 30 moves toward the stationary die 28 to deform the panel blank 22 into the formed shape. The moveable die 30 moves away from the stationary die 28 to allow removal of the panel blank 22 from the die set 26, after it has been formed into the formed shape. Although the two halves of the die set 26 are described as the moveable die 30 and the stationary die 28, it should be appreciated that these terms are generic, and that the process described below may be practiced with two moveable die 30 halves. Furthermore, it should be appreciated that the process described below may be practiced with more than the two die halves described herein, i.e., the moveable die 30 and the stationary die 28. Accordingly, the process should not be limited to only two die halves, and the scope of the claims should be interpreted to include processes executed with more than the two die halves described in the exemplary embodiment.

Figure 10:
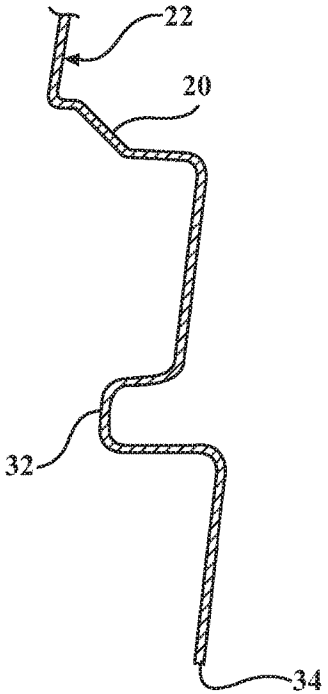
FIG. 10 is a schematic fragmentary cross sectional view of the panel blank in the formed shape.

As described above, the intermediate shape of the panel blank 22 is deformed in the die set 26 to define the final formed shape of the panel blank 22, best shown in FIGS. 2 and 10. As best shown in FIGS. 2 and 10, the final formed shape of the panel blank 22 includes the brazing surface 20, and a bead 32 that extends generally parallel with the path 24 of the brazing surface 20. The bead 32 extends in a continuous and uninterrupted, generally parallel relationship with the brazing surface 20. In the exemplary embodiment shown and described herein, the bead 32 is disposed between the brazing surface 20 and an edge 34 of the panel blank 22 adjacent the brazing surface 20. However, it should be appreciated that the bead 32 may be formed in a portion of the panel blank 22 that is not near an edge of the panel. In the exemplary embodiment shown and described herein, the bead 32 is disposed within an addendum 64 of the panel blank 22. As used herein, the term "addendum 64" is defined as an excess portion of the panel blank 22 that is not part of the finished, formed product. However, it should be appreciated that the bead 32 does not need to be formed in the addendum 64, and may be part of the finished, formed product.

Referring to FIGS. 4 through 9, the die set 26 includes a clamping device, referred to hereinafter as a clamp 36. The clamp 36 may be coupled or attached to the stationary die 28, and is operable to secure the panel blank 22 to the stationary die 28. The clamp 36 may include any device capable of securing the panel blank 22 relative to the stationary die 28. The clamp 36 may be an independent component of the die set 26, or may alternatively be part of the moveable die 30. The clamp 36 may be moved between a clamping position, in which the clamp 36 is engaged with and secures the panel blank 22 relative to the stationary die 28, and a release position, in which the clamp 36 is moved away from the stationary die 28 to release the panel blank 22.

Figure 9:
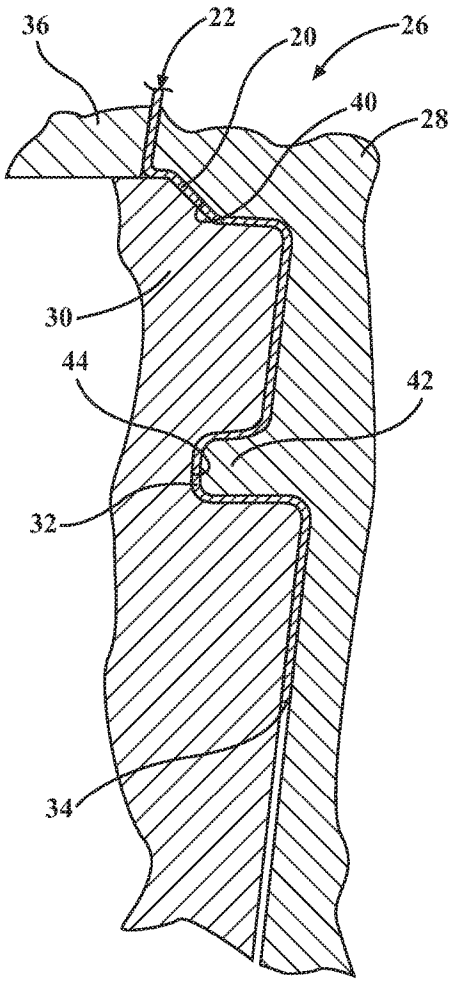
FIG. 9 is a schematic fragmentary cross sectional view of the panel blank disposed between the moveable die and the stationary die in a final die position.

Referring to FIGS. 4 through 9, the moveable die 30 includes a moveable brazing formation surface 38, and the stationary die 28 includes a stationary brazing formation surface 40. When the moveable die 30 is brought into a final pressing position, such as shown in FIG. 9, the moveable brazing formation surface 38 is disposed opposite the stationary brazing formation surface 40, with the panel blank 22 therebetween. The moveable brazing formation surface 38 and the stationary brazing formation surface 40 cooperate together to form the brazing surface 20 in the panel blank 22 therebetween. It should be appreciated that the moveable brazing formation surface 38 and the stationary brazing formation surface 40 each extend along the entire path 24 of the brazing surface 20.

Referring to FIGS. 4 through 9, one of the moveable die 30 and the stationary die 28 includes a male bead forming portion 42, and the other of the moveable die 30 and the stationary die 28 includes a female bead forming portion 44. When the moveable die 30 is brought into a final pressing position, such as shown in FIG. 9, the female bead forming portion 44 is disposed opposite the male bead forming portion 42. The male bead forming portion 42 and the female bead forming portion 44 cooperate together to form the bead 32 in the panel blank 22 therebetween. The male bead forming portion 42 and the female bead forming portion 44 both extend in a continuous and uninterrupted, generally parallel relationship with the moveable brazing formation surface 38 and the stationary brazing formation surface 40. As shown in the Figures, the male bead forming portion 42 is disposed on the stationary die 28, and the female bead forming portion 44 is disposed in the moveable die 30. However, it should be appreciated that the relative positions of each may be reversed, such that the male bead forming portion 42 is disposed on the moveable die 30, and the female bead forming portion 44 is disposed in the stationary die 28. Referring to FIG. 10, the male bead forming portion 42 and the female bead forming portion 44 are transversely positioned or laterally offset relative to the brazing surface 20 to position the bead 32 in the panel blank 22 a distance 46 from the brazing surface 20. It should be appreciated that the distance 46 between the bead 32 and the brazing surface 20, i.e., the distance 46 between the female bead 32 forming surface and the moveable brazing formation surface 38, and between the male bead 32 forming surface and the stationary brazing formation surface 40, may vary, and is dependent upon the specific shape and configuration of the panel blank 22.

Referring to FIGS. 4 through 9, the male bead forming portion 42 and the female bead forming portion 44 are disposed opposite the clamp 36, and across the moveable brazing formation surface 38 and the stationary brazing formation surface 40 from the clamp 36. Accordingly, it should be appreciated that the brazing surface 20 is formed in the panel blank 22 between the portion of the panel blank 22 engaged by the clamp 36, and the portion of the panel blank 22 engaged by the male bead forming portion 42 and the female bead forming portion 44.

Figure 12:
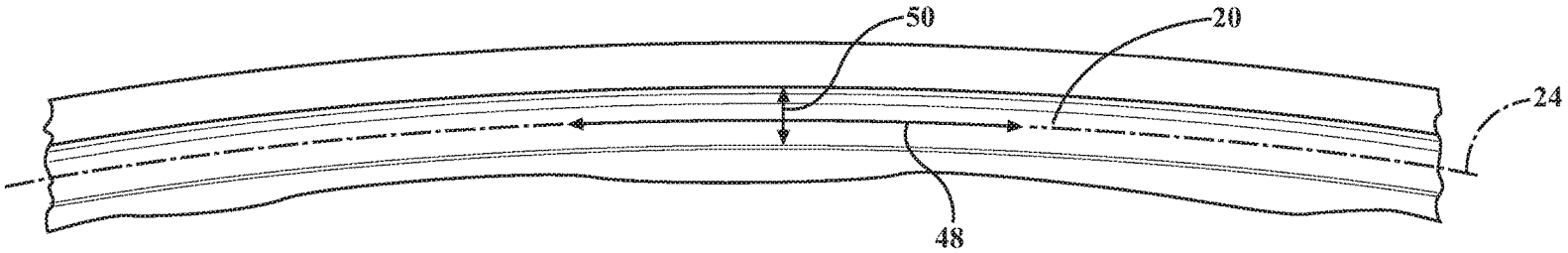
FIG. 12 is an enlarged, fragmentary plan view of the panel blank showing a first direction of the surface and a second direction of the surface.

The male bead forming portion 42 and the female bead forming portion 44 each define a cross sectional shape perpendicular to the path 24 of the brazing surface 20 that is operable to induce tensile forces in the panel blank 22 in both a first direction 48 parallel to the path 24 of the brazing surface 20, and a second direction 50 transverse to the path 24 of the brazing surface 20. Referring to FIG. 12, the first direction 48 of the panel blank 22 along the brazing surface 20 may be considered a major axis or major direction of the brazing surface 20, and the second direction 50 of the panel blank 22 along the brazing surface 20 may be considered a minor axis or minor direction of the brazing surface 20.

The cross sectional shape of the male bead forming portion 42 compliments and mates with the cross sectional shape of the female bead forming portion 44 in order to form the bead 32 in the panel blank 22 therebetween. The cross sectional shape of the male bead forming portion 42 and the female bead forming portion 44 is dependent upon the final formed shape of the panel blank 22, and may vary in order to induce and/or maintain tensile forces in the panel blank 22 in both the first direction 48 and the second direction 50 as the brazing surface 20 is being. Accordingly, referring to FIG. 4, it should be appreciated that a depth 52, a width 54, or a corner radii 56 of the male bead forming portion 42, as well as a depth 58, a width 60, or a corner radii 62 of the female bead forming portion 44 may change depending upon the specific configuration of the formed shape, as necessary to ensure that the tensile forces are maintained in both the first direction 48 and the second direction 50 of the panel blank 22 as the brazing surface 20 is being formed.

Figure 5:
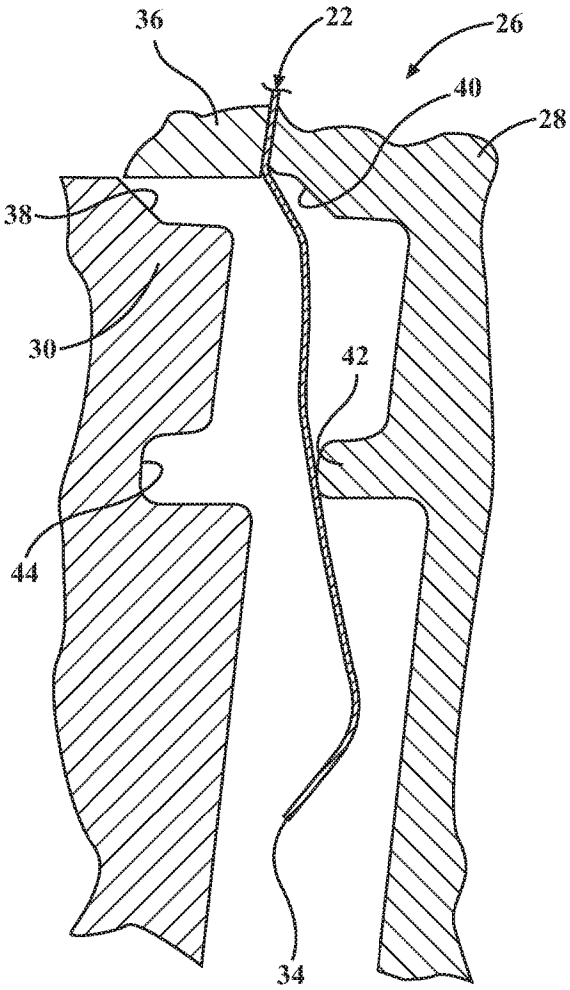
FIG. 5 is a schematic fragmentary cross sectional view of the panel blank disposed between the moveable die and the stationary die in a second die position.
Figure 4:
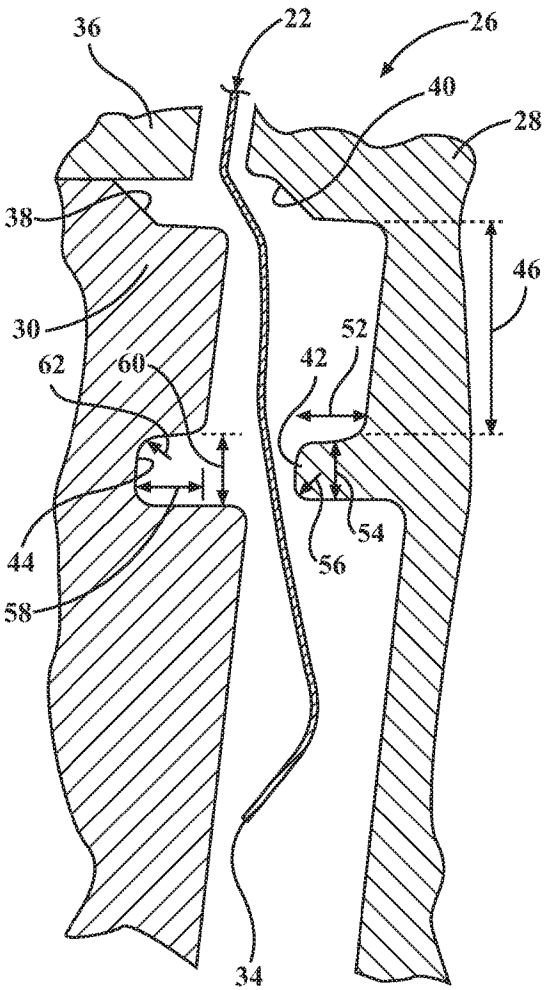
FIG. 4 is a schematic fragmentary cross sectional view of the panel blank disposed between a moveable die and a stationary die of a die set in an initial die position.

Referring to FIG. 4, the panel blank 22, which was previously formed to define the intermediate shape, is positioned between the stationary die 28 the moveable die 30. Referring to FIG. 5, the panel blank 22 is then clamped in place relative to the stationary die 28. As noted above, the clamp 36 is used to secure the panel blank 22 relative to the stationary die 28. The clamp 36 is positioned to engage a portion of the panel blank 22 immediately adjacent the portion of the panel blank 22 that is to be formed into the brazing surface 20. In the exemplary embodiment shown and described herein, the panel blank 22 is clamped to the stationary die 28 such that the portion of the panel blank 22 that defines the brazing surface 20 is disposed between the clamp 36 and the edge 34 of the panel blank 22. Furthermore, in the exemplary embodiment shown and described herein, the portion of the panel blank 22 that is to form the brazing surface 20 is disposed between the clamp 36, and the male bead forming portion 42 and the female bead forming portion 44. As noted above, the general pressing process utilized in this process is known to those skilled in the art. The steps of placing the panel blank 22 with the intermediate shape in the die set 26 and clamping the panel bland to the stationary die 28 are well known to those skilled in the art of pressing processes, and are therefore not described in detail herein.

Figure 6:
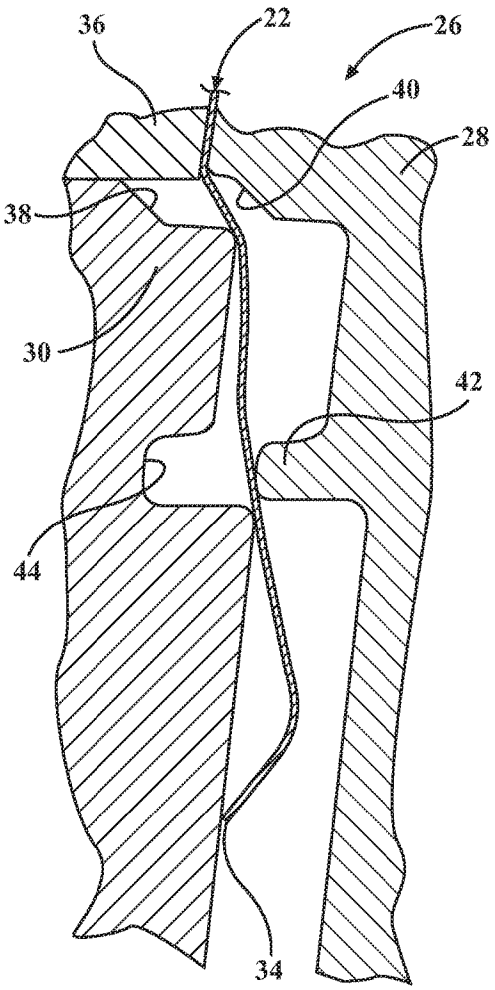
FIG. 6 is a schematic fragmentary cross sectional view of the panel blank disposed between the moveable die and the stationary die in a third die position.

Referring to FIGS. 5 and 6, the moveable die 30 is then engaged or actuated to move toward the stationary press to deform the panel blank 22 therebetween. The moveable die 30 may be moved in any suitable manner known to those skilled in the art, such as but not limited to moving the moveable die 30 with a hydraulic ram or other similar device. Positive stresses are maintained in the panel blank 22, in the region of the panel blank 22 that will form the brazing surface 20, as the moveable die 30 moves toward the stationary die 28. As used herein, the term "positive stresses" are defined as stress values greater than zero that place an object in tension, whereas "negative stresses" may be defined as stress values less than zero that place an object in compression. The positive stresses are maintained in the panel blank 22, in the region of the panel blank 22 that will form the brazing surface 20, by the formation of the bead 32 in the panel blank 22 adjacent the brazing surface 20. Accordingly, as shown in FIG. 6, the male bead forming portion 42 and the female bead forming portion 44 engage and deform the panel blank 22 therebetween, to form the bead 32 during initial movement of the moveable die 30 toward the stationary die 28, to induce tensile forces in all directions, i.e., in both the first direction 48 parallel to the path 24 of the brazing surface 20 and the second direction 50 transverse to the path 24 of the brazing surface 20.

As noted above, the bead 32 of the formed shape of the panel blank 22 is disposed between the brazing surface 20 and the edge 34 of the panel blank 22, with the brazing surface 20 of the panel blank 22 disposed between the bead 32 and the clamp 36 when positioned between the stationary die 28 and the moveable die 30. Accordingly, it should be appreciated that the panel blank 22 is secured by both the clamp 36 and the formation of the bead 32, which extends the entire length of the brazing surface 20 along the path 24 of the brazing surface 20.

Figure 8:
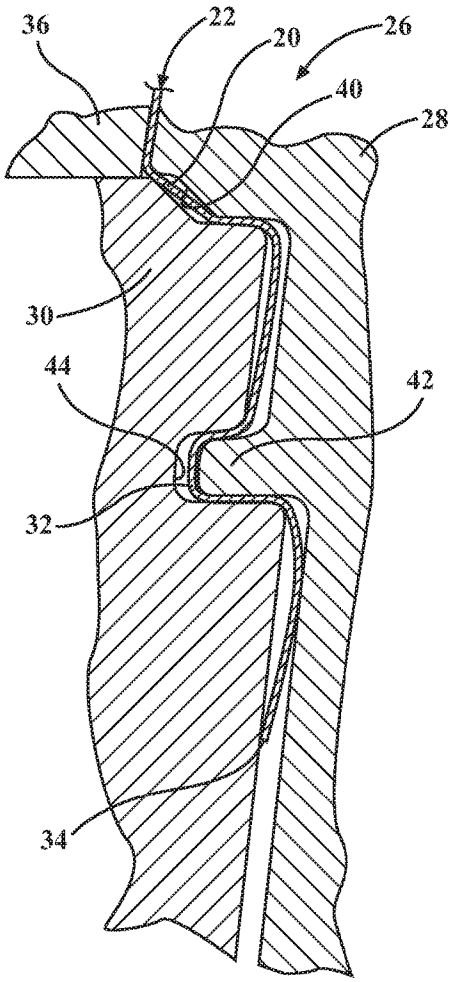
FIG. 8 is a schematic fragmentary cross sectional view of the panel blank disposed between the moveable die and the stationary die in a fifth die position.
Figure 7:
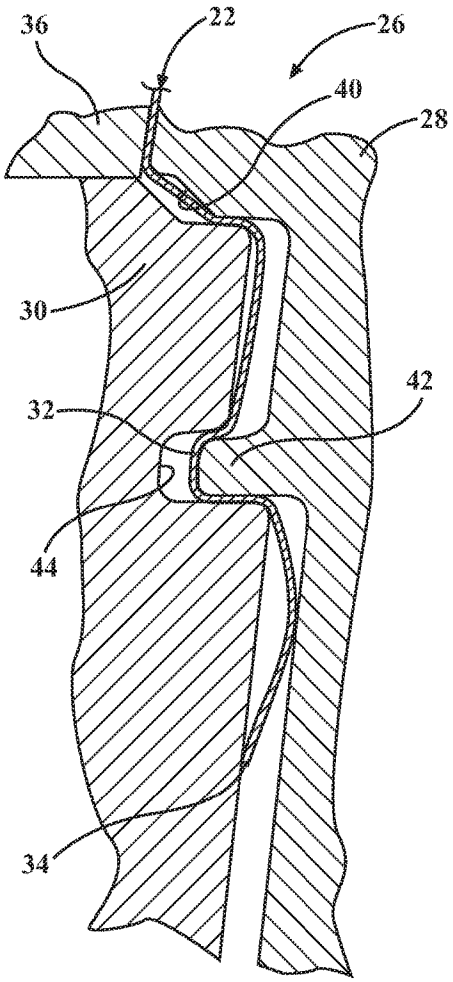
FIG. 7 is a schematic fragmentary cross sectional view of the panel blank disposed between the moveable die and the stationary die in a fourth die position.

Once the tensile stresses are induced into the region of the panel blank 22 that will be formed into the brazing surface 20, such as shown by the initial formation of the bead 32 in FIG. 6, the moveable die 30 continues to move toward the stationary die 28, generally shown in FIGS. 7 through 9, while maintaining the positive stresses in the panel blank 22 in the region of the panel blank 22 that will form the brazing surface 20, to further deform the panel blank 22 into the final formed shape, which includes the brazing surface 20. Accordingly, the brazing surface 20 is formed while the bead 32 is being formed between the male bead forming portion 42 and the female bead forming portion 44. In other words, the continued formation of the bead 32 is what maintains the tensile forces in the region of the panel blank 22 that forms the brazing surface 20, while the brazing surface 20 is being formed. By maintaining the tensile forces in the region of the panel blank 22 that forms the brazing surface 20, in both the first direction 48 and the second direction 50, no material flows into this region, which prevents compression of this region and limits waviness or deviations from an ideal shape of the brazing surface 20. As used herein, the term "ideal shape" of the brazing surface 20 should be interpreted as the intended perfect three dimensional shape of the brazing surface 20 without any waviness or any imperfections. Accordingly, the ideal shape of the brazing surface 20 would be perfectly smooth.

The brazing surface 20 formed into the panel blank 22 by the process and die set 26 described above, includes a Class "A" finish surface. The Class "A" quality finish surface is defined as a high quality surface with no undesirable waviness, and ready for laser brazing, or other finishing operations requiring a smooth surface, without additional forming or metal preparation operations, such as but not limited to filling, grinding, smoothing, etc. As such, the brazing surface 20 of the formed shape includes no undulations extending above or below the ideal shape of the brazing surface 20 a distance greater than plus or minus 0.25 mm per 250 mm.

Figure 11:
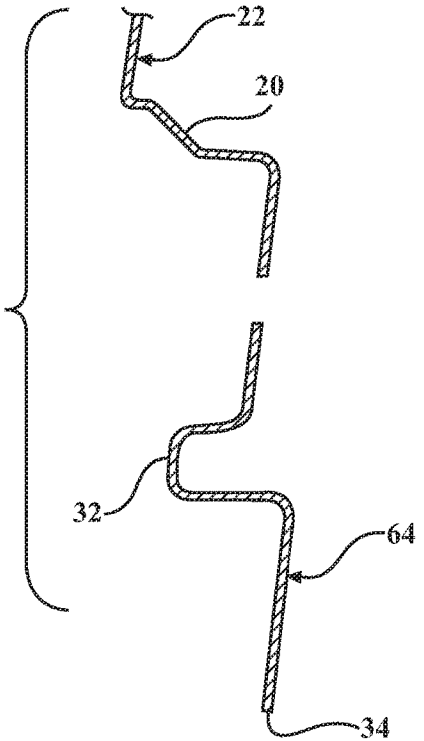
FIG. 11 is a schematic fragmentary cross sectional view of the panel blank showing an addendum of the panel blank removed.

Once the panel blank 22 has been formed into the formed shape, shown in FIG. 10, including the brazing surface 20 and the bead 32, the moveable die 30 is moved away from the stationary die 28, and the panel blank 22 may be unclamped and removed from the stationary die 28. Additionally, once the panel blank 22 has been formed into the formed shape, the addendum 64 of the panel blank 22 adjacent the brazing surface 20 may be removed, as is generally shown in FIG. 11. As noted above, the bead 32 may be formed into the addendum 64. Accordingly, it should be appreciated that the bead 32 need not be a specific feature of the finished product, and may be used exclusively for the purpose of inducing the positive stresses, i.e. tensile stresses, into the portion of the panel blank 22 used to form the brazing surface 20 during formation of the brazing surface 20. The addendum 64 may be removed in any suitable manner, by any suitable method known to those skilled in the art.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A method of forming a surface in a panel blank, the method comprising:

providing a die set having a stationary die and a moveable die that cooperate to define a formed shape therebetween, wherein one of the stationary die and the moveable die includes a male bead forming portion, and the other of the stationary die and the moveable die includes a female bead forming portion, wherein the formed shape defines the surface extending along a path, and a bead formed between the male bead forming portion and the female bead forming portion that extends parallel with the path of the surface;

wherein the bead is disposed between the surface and an edge of the panel blank;

positioning the panel blank between the stationary die and the moveable die;

moving the moveable die toward the stationary die to deform the panel blank therebetween, wherein the male bead forming portion and the female bead forming portion engage and deform the panel blank therebetween to form the bead during initial movement of the moveable die toward the stationary die to induce tensile forces in both a first direction parallel to the path of the surface and a second direction transverse to the path of the surface;

continuing to move the moveable die toward the stationary die to further deform the panel blank therebetween, while the bead is being formed between the male bead forming portion and the female bead forming portion, and while the panel blank includes tensile forces in both the first direction and the second direction relative to the path of the surface, to define the formed shape having the surface; and removing an addendum of the panel blank adjacent the surface, after the panel blank is deformed into the formed shape;

wherein the bead is disposed within the addendum of the panel blank.

2. The method set forth in claim 1 further comprising clamping the panel blank to the stationary die.

3. The method set forth in claim 2 wherein clamping the panel blank to the stationary die is further defined as clamping the panel blank to the stationary die with a clamp, whereby the clamp engages the panel blank adjacent a portion of the panel blank that defines the surface, such that the portion of the panel blank that defines the surface is disposed between the clamp and an edge of the panel blank.

4. The method set forth in claim 3 wherein the bead of the formed shape is disposed between the surface and the edge of the panel blank, with the surface of the panel blank disposed between the bead and the clamp when positioned between the stationary die and the moveable die.

5. The method set forth in claim 1 wherein the male bead forming portion and the female bead forming portion each define a cross sectional shape perpendicular to the path of the surface that is operable to induce tensile forces in the panel blank in both the first direction parallel to the path of the surface and the second direction transverse to the path of the surface.

6. The method set forth in claim 5 wherein the cross sectional shape of the male bead forming portion and the female bead forming portion is dependent upon the formed shape.

7. The method set forth in claim 1 wherein the panel blank is a body side panel of a vehicle.

8. The method set forth in claim 7 wherein the surface is a roof surface for brazing attachment to a roof panel of the vehicle.

9. The method set forth in claim 1 wherein the path of the surface is a non-linear, three dimensional path.

10. The method set forth in claim 1 further comprising pre-forming a metal panel to define an intermediate shape forming the panel blank, prior to positioning the panel blank between the stationary die and the moveable die.

11. The method set forth in claim 1 wherein the surface of the formed shape of the panel blank includes a Class A finish surface.

12. The method set forth in claim 1 wherein the surface of the formed shape of the panel blank is smooth such that the surface includes no undulations extending above or below the surface a distance greater than plus or minus 0.25 mm per 250 mm.

* * * * *